United States Patent [19]

Stinson

[11] 3,941,197

[45] Mar. 2, 1976

[54] ROTARY PERCUSSION EARTH BORING BIT

[75] Inventor: Leon B. Stinson, Houston, Tex.

[73] Assignee: Hughes Tool Company, Houston, Tex.

[22] Filed: July 1, 1974

[21] Appl. No.: 484,837

[52] U.S. Cl. ..... 175/400; 175/410

[51] Int. Cl.[2] ..... E21C 13/06

[58] Field of Search ..... 173/80; 175/393, 395, 407, 175/410, 415, 417, 418, 419, 420, 421, 231, 92, 324, 400, 422, 96, 414

[56] References Cited

UNITED STATES PATENTS

| | | | |
|---|---|---|---|
| 1,922,559 | 8/1933 | Strobel | 175/400 X |
| 3,062,306 | 11/1962 | Hjalsten | 175/418 X |
| 3,185,228 | 5/1965 | Kelly | 175/415 X |
| 3,388,756 | 6/1968 | Varel et al. | 175/418 X |
| 3,682,258 | 8/1972 | Kelly et al. | 175/410 X |
| 3,717,209 | 2/1973 | Sheldon et al. | 175/413 |
| 3,749,190 | 7/1973 | Shipman | 175/374 X |
| 3,791,463 | 2/1974 | Pearson | 175/410 X |

*Primary Examiner*—Ernest R. Purser
*Assistant Examiner*—Richard E. Favreau
*Attorney, Agent, or Firm*—Robert A. Felsman

[57] ABSTRACT

Disclosed herein is a rotary-percussion earth boring bit that has an improved geometric configuration to minimize fatigue failures and reduce manufacturing costs. The body of the bit is formed of a single mass of metal through which extends a single air course, without intermediate deflection or intersection, from a central portion of the upper, anvil surface to the face of the bit. The air course intersects this face in an offset relationship with the axis of rotation of the bit. Button type inserts are included in the face and one insert is adjacent to both the air course and the centerline of the bit.

3 Claims, 4 Drawing Figures

ROTARY PERCUSSION EARTH BORING BIT

BACKGROUND OF THE INVENTION

1. Field of the Invention

This invention relates in general to improved rotary-percussion earth boring bits and in particular to improvements in the geometric relationship of the bit and the air course arrangement to minimize fatigue failures and to reduce costs of manufacture.

2. Description of the Prior Art

The first known commercially successful rotary-percussion earth boring bit of the type having button inserts is described in U.S. Pat. No. 3,185,228, which issued to Joseph L. Kelly, Jr. on May 25, 1965. While such bits have been commercially successful, fatigue failures often occur before the button inserts serve their useful life. Fatigue failures may occur in a mid-region of the body of the bit, where cross-sectional areas vary to provide torque transmission means such as splines used to rotate the bit. Other fatigue failures occur in a lower region of the bit body, commonly near the intersection of passages through which air flows to cleanse cuttings from the bottom of the borehole.

A number of solutions to the above fatigue failure problem have been suggested in the prior art. Large radii have been used at surface intersections to minimize stress concentrations. Air courses have been reamed or ground to minimize stress raising machine marks or other imperfections. The number of air courses has been decreased. As shown in U.S. Pat. No. 3,791,462, which issued to Alfred R. Curington on Feb. 12, 1974, a single air course of two drilled holes which intersect near the mid-region of the bit has been proposed. A similar air course construction is shown in the U.S. Pat. No. 2,579,268, which issued to Johannes A. S. Malherbe on Dec. 18, 1951. Previously, one central air course, coaxial with the axis of rotation of the bit, was utilized but discontinued due to its inability to remove the earth at the center of the borehole. As a consequence, fluid flow was restricted through the air course and the effectiveness of the air operated hammer, which drove the bit, was diminished.

SUMMARY OF THE INVENTION

One of the objects of this invention is to provide an improved geometric configuration for a rotary-percussion earth boring bit such that the air course construction eliminates all intersections or intermediate deflections located between the bevels to the upper anvil surface and the lower transverse face of the bit. Another object is to utilize this air course construction in a bit body of a single mass of metal to eliminate intersection of the air course with any intermediate surface that would otherwise result if the bit were formed of two pieces. An additional object is to provide a geometric relationship between the intersection of the air course with the face of the bit and at least one button insert to improve earth disintegration and cuttings removal from the central region of the borehole. Another object is to simplify manufacturing and reduce costs. In accordance with these objects the body of the bit has torque transmission means such as splines on an upper region, which terminates in an upper anvil surface to receive successive impacts from a fluid operated hammer. An enlarged lower region with a transverse face, containing button type inserts, is formed on the bit, and the body is formed of a single mass of metal. A single air course extends without intermediate deflection or intersection from a central portion of the anvil surface into intersection with an off-set portion of the transverse face. Best results are often obtained if the off-set equals one-half the diameter of the hole. This permits at least one button insert being positioned in the face adjacent the air course and the axis of rotation of the bit. Consequently, coring of the formation at the center of the borehole bottom is prevented; air flow remains unrestricted; manufacturing costs are reduced; fatigue failures diminish. Other objects, features and advantages will become apparent hereinafter.

DESCRIPTION OF THE PREFERRED EMBODIMENT

Figure 1:
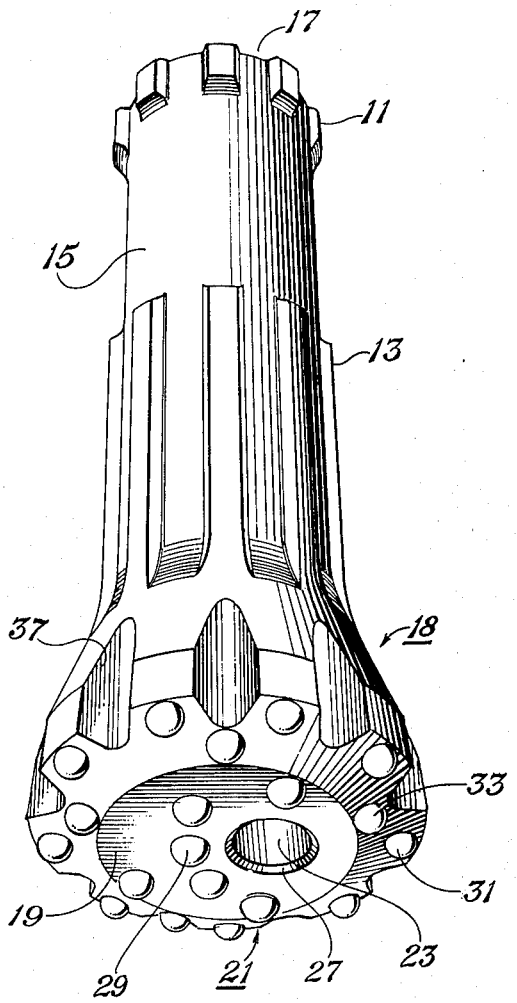
FIG. 1 is a perspective view as seen looking obliquely from a corner on the lower region of the bit body to show the preferred relationship of the transverse face of the bit with the button type inserts and the location of the air course.
Figure 3:
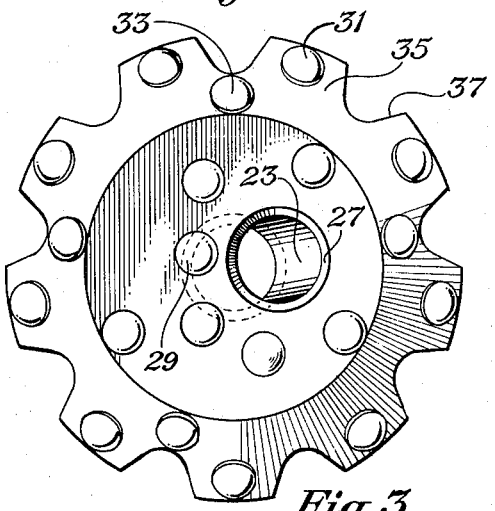
FIG. 3 is a bottom view of the bit shown in FIG. 1.
Figure 4:
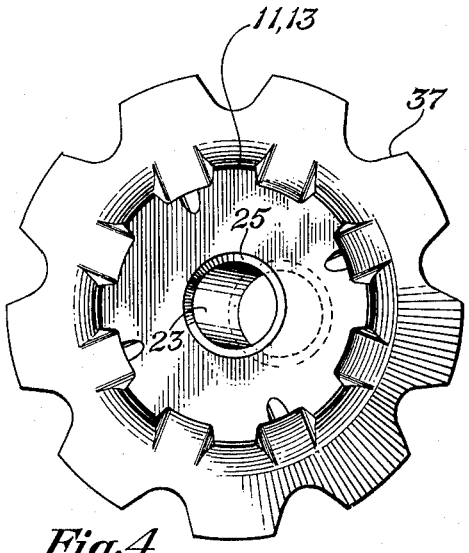
FIG. 4 is a top view of the top view of the bit shown in FIG. 1.

Referring initially to FIG. 1 of the drawing, a rotary percussion type earth boring bit is shown in perspective and includes on an upper region torque transmission means in the form of spline 11, 13 separated by a cylindrical surface 15. Splines 11, 13 are adapted to be assembled with mating splines in the housing (not shown) of a motor having a fluid driven reciprocating piston that periodically engages an anvil upper surface 17. It is conventional for a split ring (not shown) to be assembled around the cylindrical surface 15 between the splines 11, 13 to engage shoulders in the housing and retain the bit for reciprocation and rotation. Such arrangements are well known in the art and the invention is not limited to use with any particular form of housing or motor.

The bit also includes an enlarged lower region 18 that terminates in a transverse face 19 containing a plurality of button type inserts 21. The term "button type insert" refers to those wear resistant inserts described in the previously mentioned U.S. Pat. No. 3,185,228. Commonly, such inserts are constructed of sintered tungsten carbide and are well known in the art.

The body of the bit is constructed of a single mass of metal through which extends a single air course, which intersects the central portion of the upper, anvil surface 17 with a bevel 25. Preferably the central axis of the air course and the central axis of the bit body intersect on the anvil surface. From the anvil surface 17 the air course 23 extends obliquely until it intersects the transverse face 19 in an offset portion, meaning that the center of the resulting aperture on the face of the bit is offset from the axis of rotation or centerline of the bit. A bevel 27 is preferably formed at this intersection also. For the bit shown the offset is about one-half the diameter of the air course 23.

Figure 2:
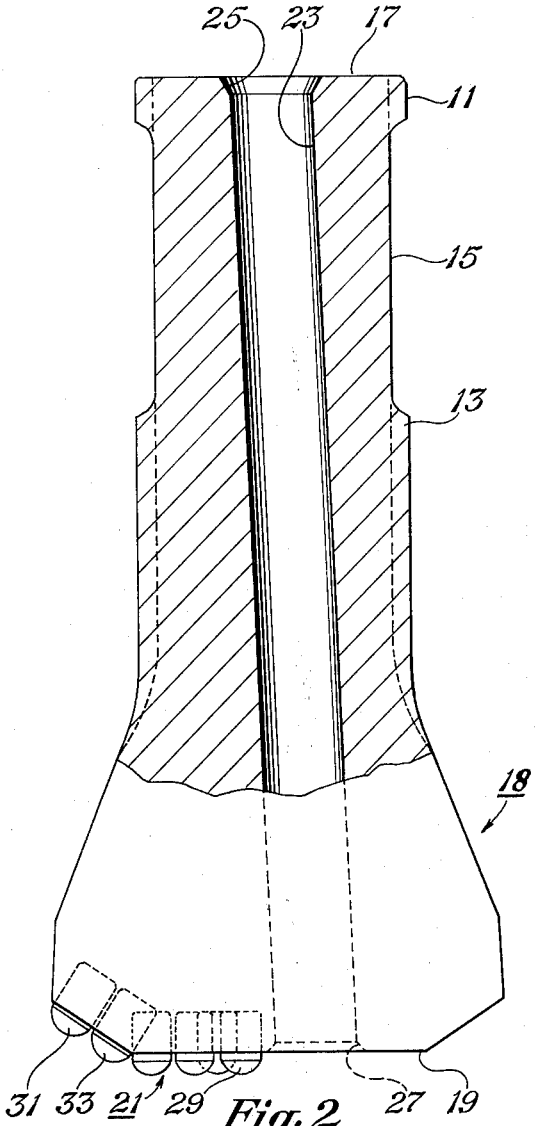
FIG. 2 is a cross-sectional view of the bit shown in FIG. 1, except some inserts have been moved to show their relative positions during rotation of the bit.

There is preferably at least one button type insert 29 positioned in the space 19 adjacent to the air course 23 and to the axis of rotation of the bit. The remaining inserts are distributed to cooperatively cover, during rotation, the borehole bottom, as indicated in FIG. 2.

An outer or heel row of inserts 31 are spaced about the circumference of the bit and have between selected ones of them adjacent inserts 33. Each of the inserts 31, 33 protrude from a conical surface 35 that forms a portion of the transverse face 19. Between each of the compacts 31 is formed a return air course 37, which like the outer row of inserts 31 are spaced about the circumference of the bit. The inserts are inserted in matching drilled holes with interference fit in the manner well known in the art.

It should be apparent from the foregoing description that an invention having significant advantages has been provided. The use of a single air course 23 extending from the upper, anvil surface 17 to the transverse face 19 without any intermediate intersection or deflection (except for entrance bevels 25, 27) eliminates any possibility of stress raisers being formed as a result of such intermediate intersections. If two or more drilled holes are used to form even a single air course, their intersection creates stress raising irregularities, which even if small are detrimental.

The body of this type of bit is subjected during operation to stress waves of large magnitude that begin with each hammer blow at the upper anvil surface and proceed at the speed of sound in metal throughout the body to the transverse face 19. Any change of geometry within the body causes deflection of these stress waves and also the concentration of stresses at surface intersections. With respect to two holes drilled from either end of the bit, which intersect, the problem is aggravated because manufacturing methods and procedures do not always permit perfectly smooth juncture between the two. Thus, minute steps or grooves are created. Frequently in the prior art an attempt is made to eliminate such irregularities by reaming or grinding, but complete removal is difficult to achieve. The utilization of a single air course 23 without intersection or deflection solves the problem caused by the intersection of two or more holes and minimizes the related problem of fatigue failures. Also, the use of a single air course results in less abrupt changes in cross-sectional area along the length of the bit body. Abrupt changes in cross-sectional area tend to concentrate stresses and are therefore to be minimized.

Furthermore, the use of the single air course 23 that is skewed such that its intersection with the transverse face 19 is offset relative to the centerline of the bit enables the use of one insert 29 positioned in the face adjacent both the air course and the axis of the rotation of the bit. This results in more complete removal of cuttings from the center region of the borehole bottom, a large supporting section of metal for the insert, and the provision of a transverse face with a minimum number of apertures. It in addition prevents the development of a core in the center of the bottom of the borehole. Such cores can plug the air course and prevent successful hammer operation. Stresses throughout the lower portion of the bit are more nearly equalized. This helps prevent the premature breakage of certain, otherwise overloaded inserts and their supporting metal.

While the invention has been shown in only one of its forms, it should be apparent to those skilled in the art that it is not so limited but is susceptible to various changes and modifications without departing from the spirit thereof.

I claim:

1. An improved geometric configuration for a rotary-percussion earth boring bit that includes a body having torque transmission means on an upper region, an anvil upper surface and an enlarged lower region with a transverse face containing button type inserts, the improvement comprising the formation of the body of a single mass of metal, a single cylindrical air course extending without deflection or intermediate intersection from a central portion of the anvil surface into intersection with an offset portion of the transverse face, and at least one insert positioned in the face adjacent said air course and the axis of rotation of the bit.

2. An improved geometric configuration for a rotary-percussion earth boring bit that includes a body having torque transmission means on an upper region, an anvil upper surface and an enlarged lower region with a transverse face containing button type inserts, the improvement comprising the formation of the body of a single mass of metal, a single cylindrical air course drilled from one end of the bit body extending without deflection or intermediate intersection from a central portion of the anvil surface into intersection with an offset portion of the transverse face, and at least one insert positioned in the face adjacent said air course and the axis of rotation of the bit.

3. An improved geometric configuration for a rotary-percussion earth boring bit that includes a body having torque transmission means on an upper region, an anvil upper surface and an enlarged lower region with a transverse face containing button type inserts, the improvement comprising the formation of the body of a single mass of metal, a single cylindrical air course extending without deflection or intermediate intersection from a central portion of the anvil surface into intersection with an offset portion of the transverse face, the off-set equalling about one-half the diameter of the air course, and at least one insert positioned in the face adjacent said air course and the axis of rotation of the bit.

* * * * *